United States Patent [19]

Augenstein

[11] Patent Number: 4,517,725

[45] Date of Patent: May 21, 1985

[54] METHOD AND APPARATUS FOR FORMATION OF PACKS OF PUNCHED PLATES USEFUL FOR SPARK EXTINGUISHING

[75] Inventor: Reiner Augenstein, Halblech/Füssen, Fed. Rep. of Germany

[73] Assignee: Otto Bihler Maschinenfabrik GmbH & Co. KG, Halblech/Füssen, Fed. Rep. of Germany

[21] Appl. No.: 454,234

[22] Filed: Dec. 29, 1982

[30] Foreign Application Priority Data

Jan. 19, 1982 [DE] Fed. Rep. of Germany ..... 3201401

[51] Int. Cl.[3] ..... B23P 17/00

[52] U.S. Cl. ..... 29/417

[58] Field of Search ..... 414/404; 53/246, 244, 53/534; 29/417

[56] References Cited

U.S. PATENT DOCUMENTS

| | | | |
|---|---|---|---|
| 1,298,172 | 3/1919 | Bush . | |
| 1,441,359 | 1/1923 | Langston | 29/417 |
| 1,915,988 | 6/1933 | Frank | 29/417 |
| 1,993,370 | 3/1935 | Goodrich et al. | 53/246 |
| 3,079,689 | 3/1963 | Peck | 29/417 |
| 3,241,289 | 3/1966 | Molins | 53/246 |
| 3,479,795 | 11/1969 | Martin | 53/244 |
| 3,500,612 | 3/1970 | Hall | 53/246 |
| 3,775,941 | 12/1973 | Bross | 53/246 |
| 3,942,237 | 3/1976 | Ongaro | 29/417 |
| 4,223,432 | 9/1980 | Carr | 29/417 |

FOREIGN PATENT DOCUMENTS 1099490 2/1961 Fed. Rep. of Germany .

*Primary Examiner*—Howard N. Goldberg
*Assistant Examiner*—Steven Nichols
*Attorney, Agent, or Firm*—Toren, McGeady, Stanger

[57] ABSTRACT

A series of plates are punched in a single punching operation from elongate strip material with the punched plates being successively then fed into a pack formation member with an essentially constant feed speed over the entire pack forming operation, with the pack formation member being moved in an essentially constant advancing speed through a pack forming advancing distance having a direction which is essentially perpendicular to the direction in which punched plates are fed into the formation member.

33 Claims, 20 Drawing Figures a.)

b.)

c.)

d.)

e.)

f.)

*

$$\frac{b}{a} = \frac{t}{l} = \mathrm{tg}\,\alpha$$

$$v_2 = v_1 \cdot \mathrm{tg}\,\alpha$$

$$q \geqq a$$

V1
24
46
126
S
48
24
30
V2
28
32

FIG. 6B
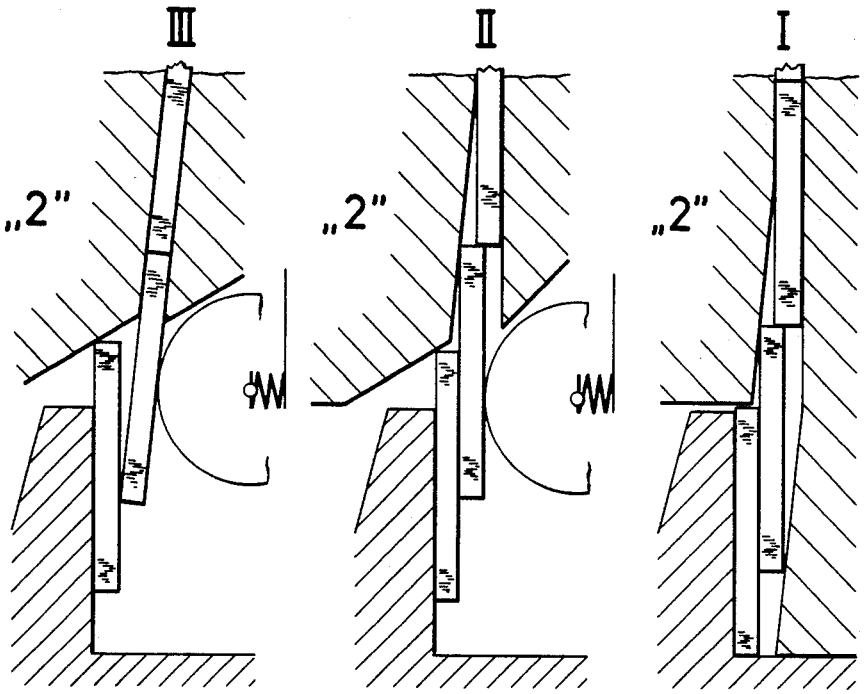
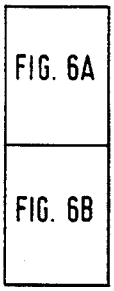
FIG. 6

METHOD AND APPARATUS FOR FORMATION OF PACKS OF PUNCHED PLATES USEFUL FOR SPARK EXTINGUISHING

The present invention relates generally to a method and apparatus for forming punched plates into a pack of plates which is particularly useful for spark extinguishing and more specifically the invention relates to a sheet punch machine and punched plate stacking equipment for assembling the punched plate packs.

Generally, the invention is directed toward developing a method of the type described wherein the packs may be manufactured with shorter cycle times thereby providing greater machine output.

SUMMARY OF THE INVENTION

In accordance with the invention, individual packs of punched plates are continuously formed in the apparatus of the invention by a method which comprises the steps of: intermittently advancing elongate sheet material to a punching station; punching from said sheet material at the punching station in a single punching operation a number of punched plates sufficient to form one of said individual packs; moving said punched plates in the longitudinal direction of said sheet material to a formation member for forming said number of said punched plates into a pack and sequentially depositing the punched plates into the formation member during a pack forming operation; said punched plates being moved to said formation member with a feed velocity which is essentially constant substantially throughout said pack forming operation; and moving said formation member at an essentially constant pack forming speed during said pack forming operation through a given advancing distance in a direction which is essentially perpendicular to the direction in which the punched plates are deposited into said formation member.

The apparatus of the invention comprises means for intermittently feeding the elongate sheet material to the punching station through a length sufficient to form plates consisting of a complete pack; multiple punching means at the punching station for punching in a single operation a plurality of plates for forming a pack from the sheet material; plate feeding means for moving the punched plates from the punching station to a pack forming station; pack formation means at the pack forming station for receiving the punched plates; advancing means for moving said pack formation means along a pack forming advancing distance from a starting position to an end position; transport guidance means connecting with said formation means at said pack forming station for moving said formation means to an ejection station; pack ejection means at the ejection station and means for interdependently controlling the multiple punching means, the plate feeding means, the advancing means, the transport guidance means and the ejection means in such a manner that the feeding means and the advancing means operate with an essentially constant speed until said pack formation means has reached the end position of the advancing distance, the pack formation means being then further transported into said ejection station where said plate pack is ejected, said pack formation means being then moved back into said starting position of said advancing distance whereupon said punching process for a next-formed plate pack is commenced before the formation has completed its return to the starting position.

Thus, in accordance with several of the important features of the invention, a single punching operation is effective to punch from the sheet material a sufficient number of plates to form one complete pack. The punched plates after punching are subsequently successively fed to a pack forming member with a feed speed which is essentially constant over the entire pack formation phase with the pack formation member being moved with an essentially constant pack-forming advancing speed through a pack-forming distance, the plates being fed into the pack forming member in a feed direction which is essentially perpendicular to the pack forming advancing direction in which the pack formation member is moved.

The method and apparatus of the invention are particularly suitable for manufacturing of spark extinguishing elements which consist of a plurality of metal plates arranged parallel to each other, with the plates being held either at a distance from each other or closely adjoining. The various specific aspects of the invention therefore relate to the formation of packs of plates where the plates are either spaced apart or closely adjoining.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figures 1, 1A:
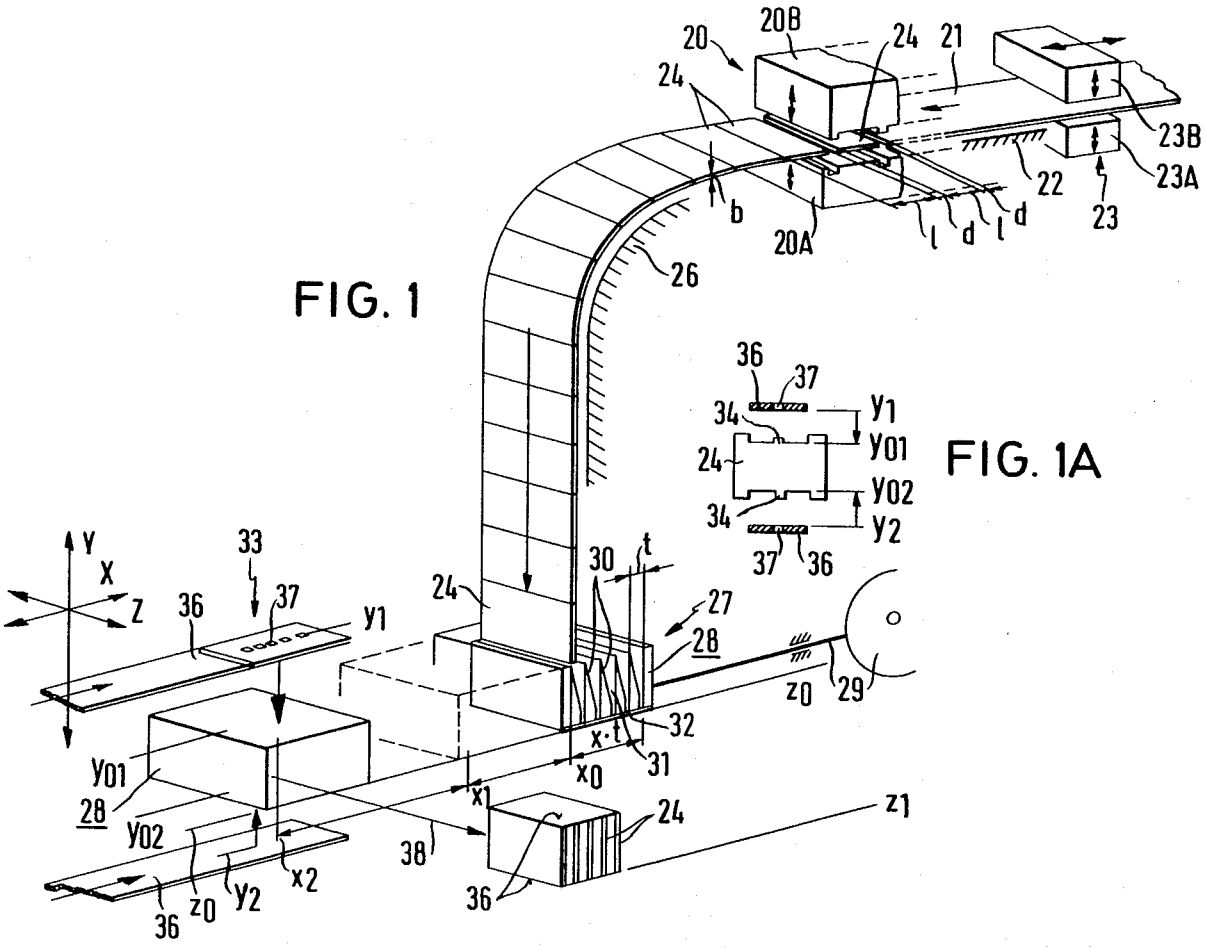
FIG. 1 is a perspective schematic view showing the apparatus of the invention.
FIG. 1A is a partial sectional view showing a detail of the apparatus of FIG. 1.
Figure 3:
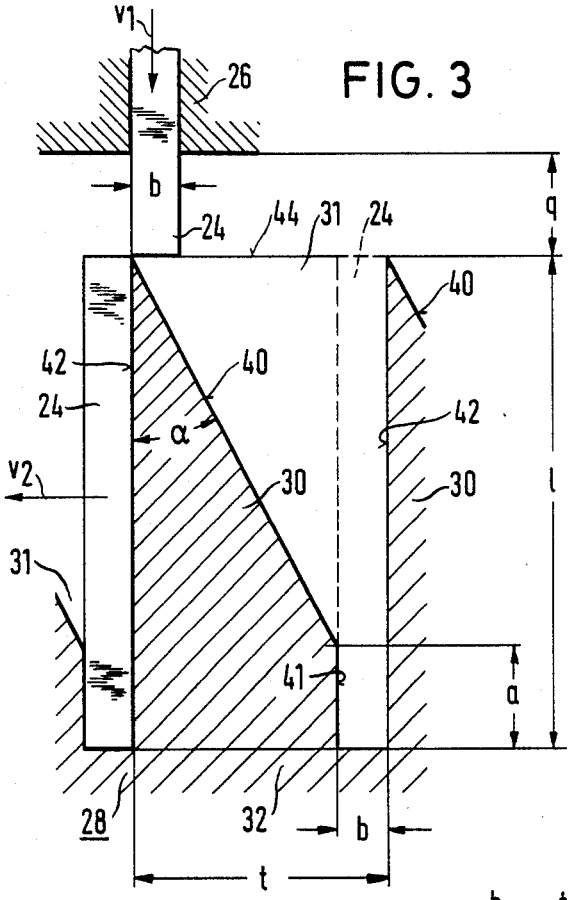
Figures 4, 4A:
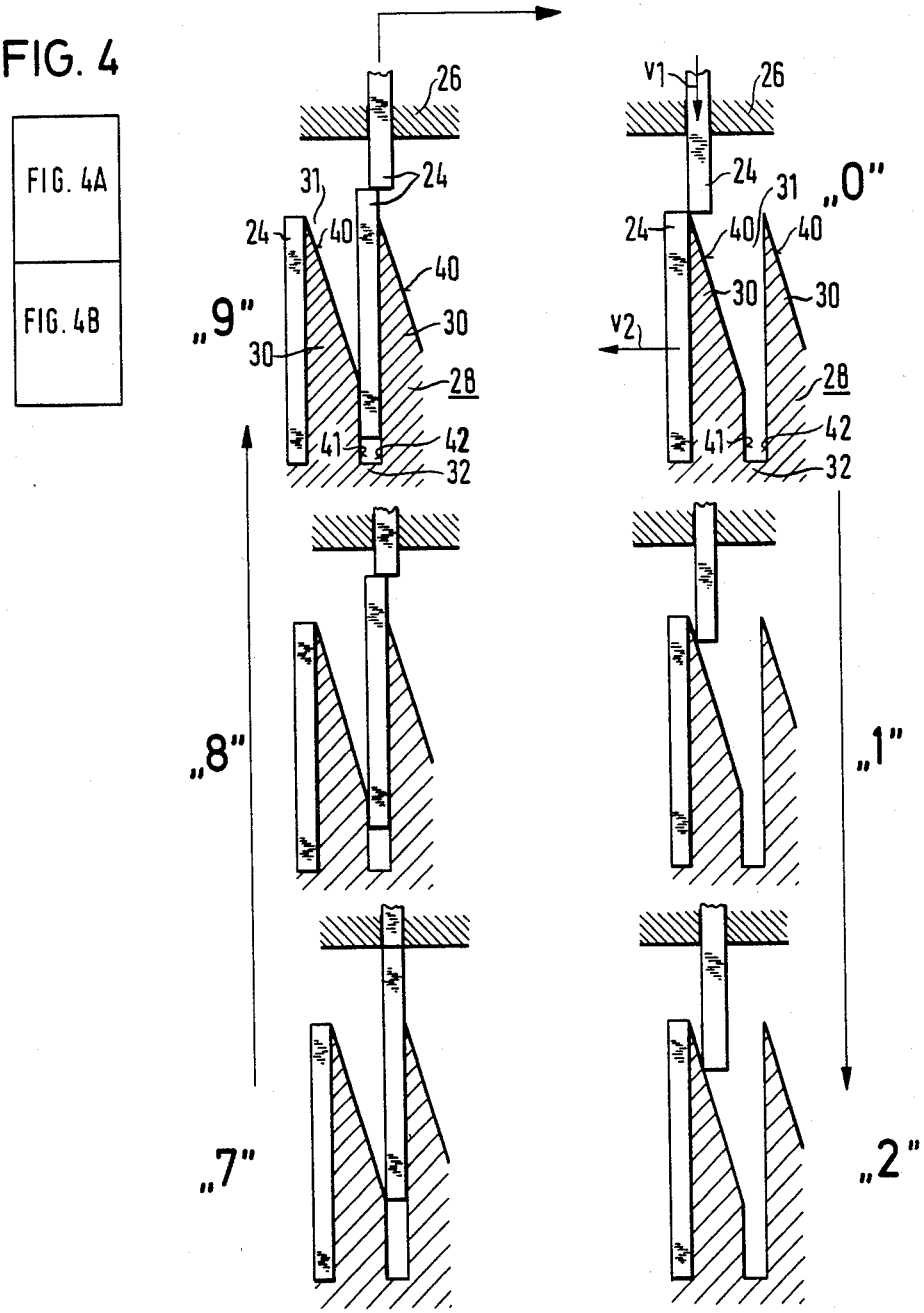
Figure 4B:
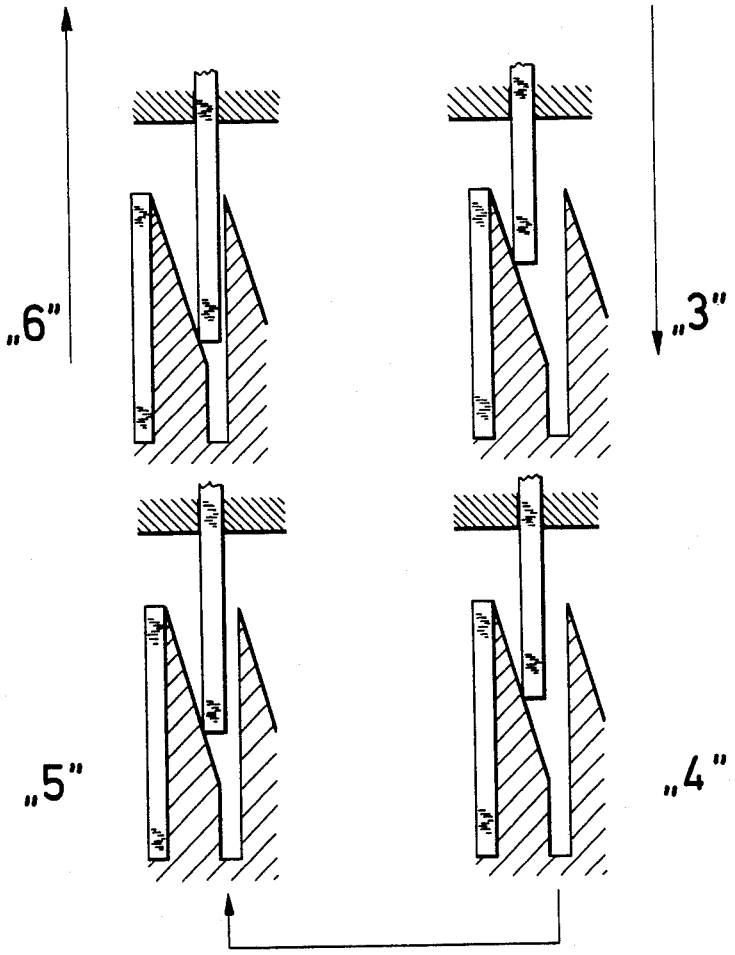
Figure 5:
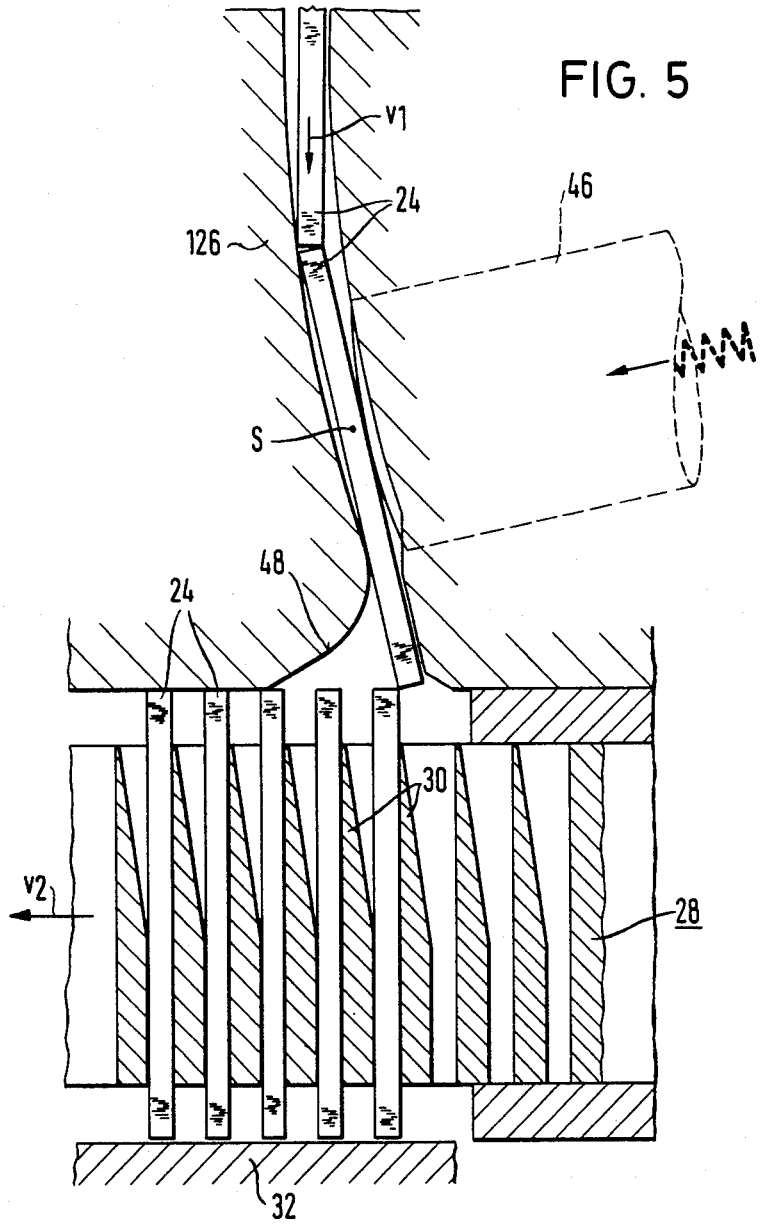
Figure 6A:
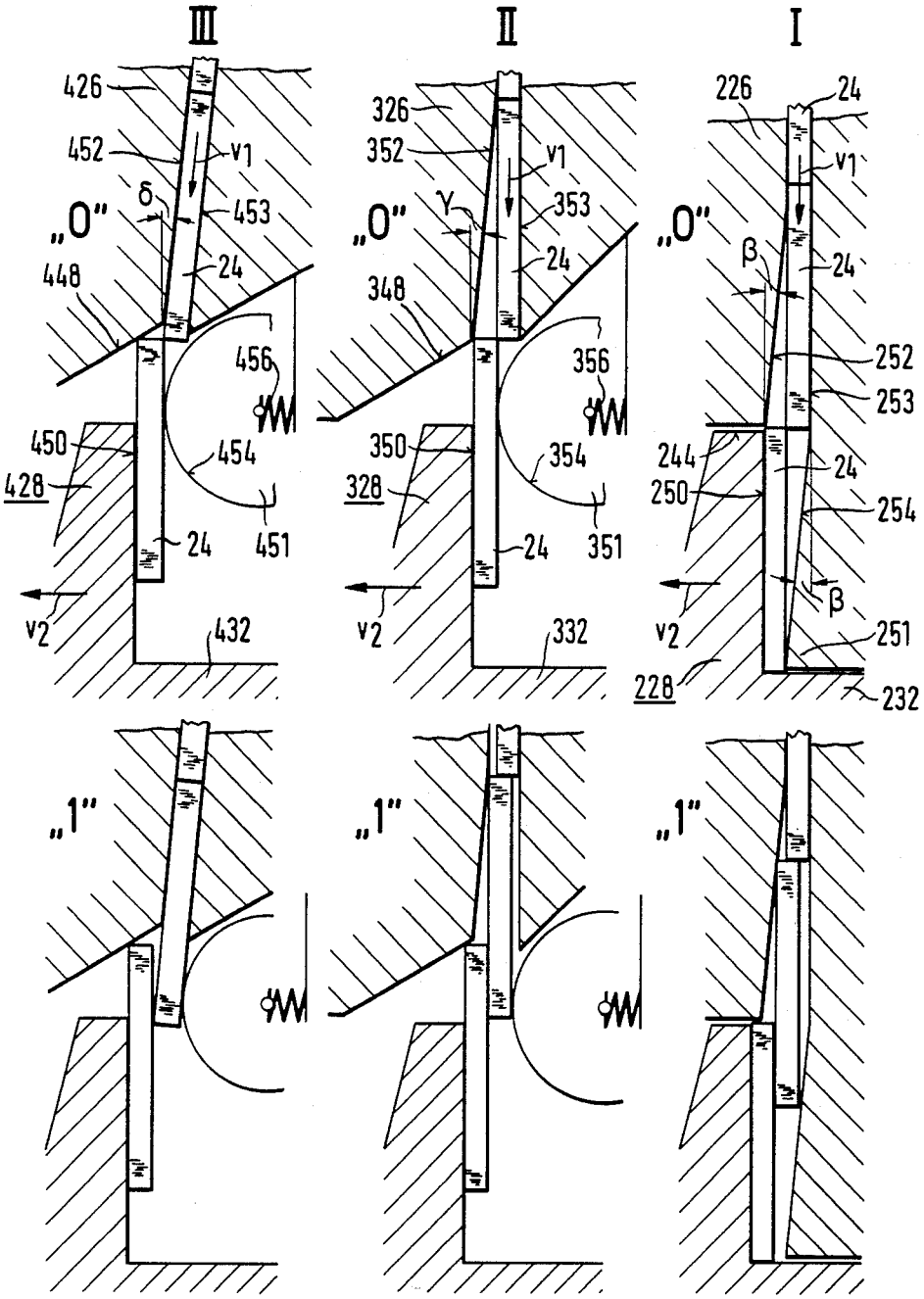

FIGS. *2a–f* are a series of graphical representations depicting the operating sequences of the different machine functions of the apparatus depicted in FIG. 1;

FIG. 3 is a sectional view showing a pack formation member during a pack forming operation positioned relative to a plate feed wherein a pack is formed with individual plates spaced apart;

FIG. 4 is a schematic diagram showing the juxtaposition of FIGS. 4A and 4B taken relative to the direction of sequential operations depicted therein;

FIGS. 4A and 4B are schematic sequential sectional diagrams showing the insertion of plate members into a pack formation member;

FIG. 5 is a sectional view showing a modification of the mechanism for feeding plates into a pack formation member;

FIG. 6 is a schematic diagram showing the juxtaposition of FIGS. 6A,I,II,III and 6B,I,II,III indicating the direction of sequential steps depicted therein; and FIGS. 6A,I,II,III and 6B,I,II,III are schematic sequential sectional diagrams showing pack formation operations during which individual plates are fed into a pack formation member wherein the plates are arranged adjoining each other.

DETAILED DESCRIPTION OF THE PREFERRED EMBODIMENTS

Referring now to the drawings, and more particularly to FIG. 1, there is shown a pack formation apparatus which includes a multiple punching device generally identified with reference numeral 20 which consists of a bottom tool 20A and a top tool 20B. In the formation of the punched plates for forming the packs of the invention, elongate sheet material 21 is moved in the direction of the arrows to the multiple punching device 20 by means of a sheet feeding mechanism 22. The sheet material 21 is moved by operation of a sheet advance device 23 which includes a pair of clamping jaws 23A and 23B. The clamping jaws engage the sheet material during advancement thereof and operate to move the sheet material 21 toward the left, as viewed in FIG. 1.

When the sheet material has been moved forwardly through a sufficient length, the clamping jaws 21A and 21B disengage from the sheet material and are moved to the right while being disengaged so that they may then be positioned to re-engage the sheet material for a further sheet feeding operation. Thus, it will be seen that the sheet advance mechanism operates to intermittently move the sheet material 21 through a specified length during each engagement cycle so as to feed to the punching device 20 an amount of sheet material sufficient to comprise a number of plates constituting a single pack.

In the multiple punching device 20, the sheet material 21 is punched in a single punching stroke into a plurality of successive plates 24, the number of plates thus produced in a single punching operation being the number required for forming of one pack of plates. During the punching operation, there results between successive plates 21 punch gaps d. The plates 24 are fed by means of a plate feed mechanism 26 to a pack formation station 27. The feeding of the plates 24 to the formation station 27 occurs with an essentially constant feed velocity inasmuch as the upstream end of the sheet material which has not as yet reached the punching device 20 is driven intermittently by the sheet advancing mechanism 23 thereby pushing the plates 24 forwardly.

The plates 24 are cut with a length l taken in the feed direction of the sheet material. The sheet material and consequently the plates 24 have a thickness b and the contour of the plates is indicated schematically in FIG. 1A.

When the plates reach the plate formation station 27, they are deposited into a pack forming member 28 which is movable in the direction of the axis x by operation of transport guidance means 29. The pack formation member 28 comprises a comb-like configuration with members 30 being arranged to define spaces therebetween in the form of receiving cells 31 into which the plates 24 are deposited.

In the position shown in FIG. 1, the pack formation member 28 is located so that the space 30 which is furthest to the left is positioned at a location $x_0$. The pack formation member 28 is moved to the left with an approximately constant speed from the position shown in FIG. 1 to a distance x·t, wherein x is the number of cells 31 in the pack formation member 28 and t is the spacing of the cells. The member 28 is driven by the transport guidance means 29 which may be formed of a rotating cam and a ram. While the pack formation member is moved to the left with a constant speed from the position shown in FIG. 1 in solid line, the plates 24 which are also fed with a constant velocity will move sequentially and successively into the cells 31 until they are brought to rest in the lower part of the pack formation member 28 against a bottom strip 32. As soon as a cell 31 which is located to the far right shown in FIG. 1 is filled with a plate 24, the pack formation member will have reached the position shown in FIG. 1 in broken line form at which the most forward spacer member 30 will occupy a position identified as $x_1$. From this position, the pack formation member is then moved further along the axis x toward the left into a position shown in FIG. 1 in solid square form at which the first spacer 30 will have reached the position $x_2$. The pack formation member is now at a processing and ejection station 33.

It should be noted that, as shown in FIG. 1A, the plates 24 are formed with recesses at the upper and lower edges thereof whereby securing projections 34 are defined. The securing projections 34 are not covered by the bottom strip 32 of the pack formation member 28 so that, while the pack formation member 28 is in the ejection and processing station 33, securing bands 36 having punched out areas 37 may be applied to the top and bottom edges of the plates 24 in order that the punched areas 37 may engage and receive therein the securing projections 34. The securing bands 36, as will be evident from the left half of FIG. 1, are moved in the direction of the arrow, i.e., in the direction of the axis x from the left to the right.

Cutting means (not shown) operate to cut off from the securing bands 36 strips which correspond to a pack length of a pack formed from the plates 24. The securing bands 36 are inserted at a level $y_1$ or $y_2$ into the processing and ejection station 33 and they are then pressed with placement tools (not shown) in the direction of the axis y into a position $y_{01}$ and $y_{02}$ where, as shown in FIG. 1A, they are engaged with the upper and lower plate edges and with the securing projections 34 so as to be arranged within the punched out areas 37.

The completed pack which is secured by means of the strip material 36 is ejected from the ejection station 33 by an ejection device 38 indicated schematically with an arrow in FIG. 1. The ejection direction is in the direction of the axis z from the rear to the front out of the pack forming support 28, i.e., from a position $z_0$ into a position $z_1$.

Figure 2:
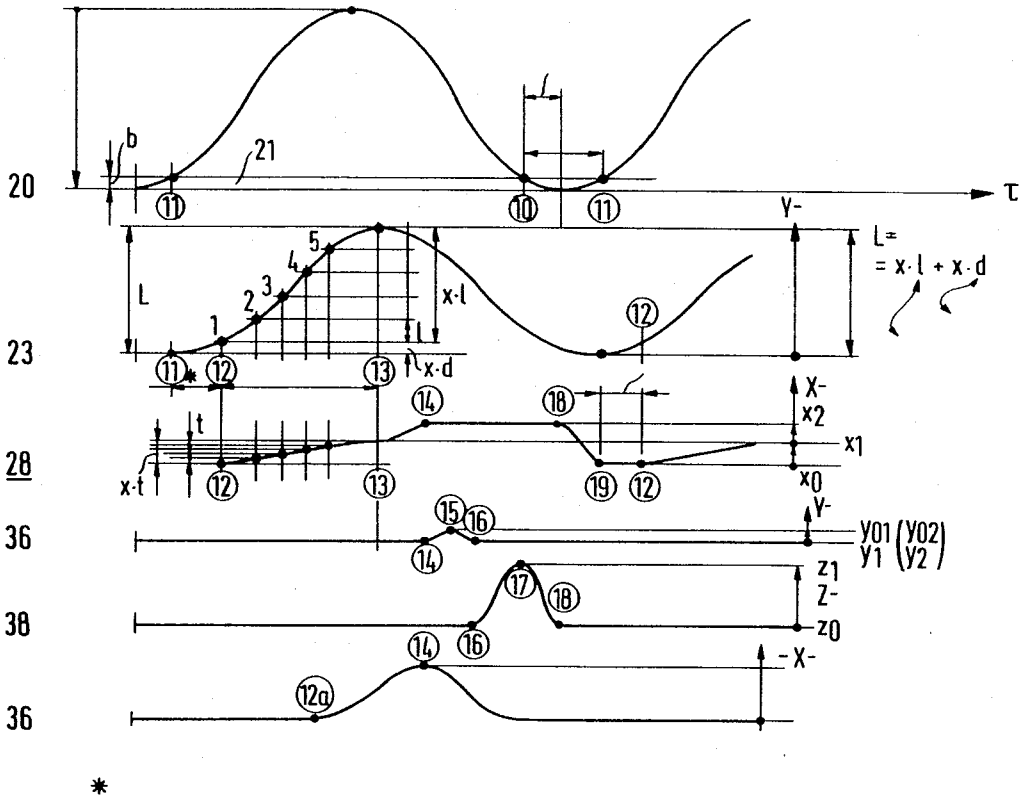

In FIG. 2 the various operating sequences of the machine are shown in graphical representation. The graphical representation (a.) indicates the stroke of the multiple punching device 20. It is assumed that the stroke of the punching device observed over a period of time $\tau$ moves in a sinusoidal pattern as indicated in graph (a.). The thickness b of the sheet material 21 is indicated in graph (a.) and it will be seen that at point 11 the multiple punching device has just emerged from the sheet material 21 and at point 10 the multiple punching device 20 again penetrates the sheet material 21 in order to be again withdrawn therefrom at a subsequent point 11. In the time period from point 11 to point 10, the sheet material 21 may be inserted into the multiple punching device 20 by the sheet material advance mechanism 23 through a length corresponding to the sum of the lengths of a number of plates 24 which are necessary to form a single pack.

Graph (b.) in FIG. 2 depicts over the time period indicated the course of motion which is imparted by the advance mechanism 23 to the sheet material 21 and the plates 24. The advance motion starts at the point 11 which corresponds with a similar point 11 shown in graph (a.) because only at this point will the multiple punching device have been withdrawn from the sheet material 21. During the beginning of the movement of the advance mechanism 23, first gaps d which occur between successive plates 24 are eliminated. This occurs between the point 11 and the point 12 as indicated in graph (b.) of FIG. 2. At point 12, the space d between successive plates is eliminated and in time intervals indicated at 1, 2, 3, 4, and 5 in graph (b.), which follow after the point 12, five successive plates 24 are moved one after another into cells 31 of a pack forming member 28. The insertion of the five plates which form a pack is completed at the point 13 in graph (b.).

Graph (c.) in FIG. 2 shows the motion of the pack forming support 28 which begins at point 12, i.e., at a point after the plates have been pushed together to eliminate the gaps d when the first plate 24 begins to enter into the first cell 31. The motion of the pack forming member 28 occurs beginning from point 12 up to point 13. At point 13, the pack forming member 28 has reached the position $x_1$ and is then, as shown in graph (c.), moved further into position $x_2$ between point 13 and point 14. Position $x_2$ corresponds to ejection station 33 shown in FIG. 1.

Graph (d.) depicts the movement of the securing band 36 and, as shown at the point 14,the pressure of the securing band 36 to the completed pack begins wherein the securing bands 36 are moved from the position $y_1$ into the position $y_{01}$ or from the position $y_2$ into the position $y_{02}$. Directly following this stage, tools (not shown in the drawing) which place the securing bands 36 move back into the positions $y_1$ and $y_2$ at points 15 and 16.

Graph (e.) shows the ejection of the pack and after return of the tools which have placed the securing bands 36 on the pack into their initial position $y_1$ or $y_2$, the ejection of the completed pack begins. It will be seen that from the point 16 up to the point 17 the ejector 38 effects an ejection movement and subsequently between points 17 and 18 it returns again from the position $z_1$ into the position $z_0$.

Graph (f.) shows the advancement of the securing band and finally the feed of the securing bands 36 is shown which begins at point 12*a* and which is completed at the beginning of the pressure of the securing bands 36 to the formed pack at point 14.

As shown in graph (c.), the pack forming member after ejection of the pack at point 18 returns to the initial position $x_0$ in the time interval between points 18 and 19 before the punching process during point 11 is completed. Between the points 19 and 12 there is, as evident in graph (c.) of FIG. 2, a safety interval available.

It will be seen from FIG. 2 that a stroke of the multiple punching device 20 and the stroke of the feed advance mechanism 23, both of which have an approximately sinusoidal course, can be derived from a crank or a sinusoidal cam with the advance of the pack forming member 28, pressing movement of the securing bands 36, movement of the ejector 38 and the advance of the securing bands 36 being derived from a correspondingly constructed cam wherein all crank drives and cams may be driven from a common drive shaft as is conventional in wire and sheet punching and bending machines.

It is important that during return of the pack forming member 28 from the position $x_2$ into the position $x_0$ there be available a sufficient span of time from the point 18 to the point 19. If, as is provided in accordance with an alternate mode of the invention, the plates are punched out successively, then the course of the punch stroke as indicated in graph (a.) would be correspondingly at a high frequency and for the return stroke of the pack forming member 28 a much shorter time would be available. However, it is possible to utilize auxiliary means for laterally sliding the individual plates out of the feed path of the feed material and, after accumulation of a number of plates which correspond to a pack to be formed, the plates may be moved again together successively in the longitudinal direction with a separate plate advance which could again have an approximately constant advancing speed.

FIG. 3 shows in section a pack forming support member 28 located relative to the end of the plate feed mechanism 26 approximately in the position $x_0+l\times t$, wherein a plate 24 just begins to move into a cell 31. The spacer 30 has an inclined surface 40, a rearward pack forming surface 41 and a front pack forming surface 42. The feed speed of the plate 24 is identified as $v_1$, the advancing speed of the pack forming member 28 is $v_2$, and the angle between the oblique surface 40 and the front pack forming surface 42 is $\alpha$, with spacing t between corresponding plate surfaces. The plates have a plate thickness b and the space between successive front and rear pack forming surfaces is also identified by b since it corresponds to the thickness of the plate 24. The height of the rear pack forming surface 41 is a and the distance of the inlet side 44 of the pack forming member 28 from the facing end of the guidance 26 is q.

The height of the pack forming support from the bottom 32 up to the inlet side 44 is l and this height corresponds in the case of the example to the plate length which also is identified as l in FIG. 1. The geometric relationships between the individual geometric sizes of FIG. 3 and the relation between the speeds $v_1$ and $v_2$ which are caused by these geometric dimensions are shown in the equation of FIG. 3.

When the relationships shown in FIG. 3 are maintained, the plate 24 moves first over the inclined surface 40 wherein it is pushed downwardly by a subsequent plate and thus finally by means of the advance 23. When the lead end of the plate 24 reaches the area of the rear pack forming surface 41, then the plate 24 must have already left with its trailing end the plate feed 26 so that no blocking will occur.

FIGS. 4A and 4B show a sequence of nine stations and with FIGS. 4A and 4B arranged as indicated in FIG. 4, the sequence begins at "0" in FIG. 4A, continues to "4" in FIG. 4B, and ends at "9" in FIG. 4A, as indicated by the arrows in FIGS. 4A and 4B. Nine stations are shown during the time that the plate 24 enters into the cell 31 and the position "0" in FIG. 4A corresponds to that shown in FIG. 3.

FIG. 5 shows a modification of the mechanism for feeding the plates into the plate forming member and, as indicated in FIG. 5, a modified plate feed 26 is provided in order to feed plates 24 to the pack forming support 28. As indicated, the plate feed 126 need not be strictly perpendicular to the advancing direction of the pack formation member 28. It will also be evident from FIG. 5 that plates 24 which enter in a straight line have in the plate feed 126 a certain swivel play about a swivel axis S extending perpendicularly to the plane of the drawing. The swivel motion occurs against the action of a spring loaded piston 46 which forms a part of the feed 126. The swivel motion of the entering plate 24 makes it possible for the leading edge of an entering plate to be disengaged from the trailing end of a plate which has already been inserted into the member 28 before the forwardmost plate has reached the bottom 32 of the member 28. In this way, the danger of a plate hanging incorrectly while running up the upwardly directed point of the respective spacer 30 is reduced.

Premature uncoupling of the trailing end of one plate with the leading end of a respective subsequent plate makes it necessary that the leading plate which is no longer pushed by the following plate down to the level of bottom 32 of the pack forming member 28 be transported or moved to the bottom 32 in another manner. For this purpose, an inclined plate insertion surface 48 at the inlet of the plate feed 126 is provided to assist in placement of the plate if the force of gravity is not sufficient.

While the embodiments shown in FIGS. 1, 3, 4A, 4B and 5 result in a pack formation in which the plates are spaced apart from each other inside of the pack, FIGS. 6A and 6B represent embodiments wherein the plates are packed in an arrangement directly adjoining one another.

The juxtaposition of FIGS. 6A and 6B to represent the sequences involved is shown in FIG. 6. FIGS. 6A and 6B combined show three different sequences of operation indicated as I, II, and III. In the operating sequence I, steps "0" and "1" are shown in FIG. 6A and the succeeding step "2" is shown in FIG. 6B. A similar arrangement is involved for sequences II and III.

In sequence I, a pack forming member 228 is again moved to the left with an essentially constant advancing speed $v_2$ and the plates 24 enter with a feed speed $v_1$ through a plate feed 226. The pack formation member 228 is constructed as a casing which is limited on one side by a front wall 250 and is open on the right side wherein an extension 251 of the plate feed 226 extends into this casing. The plate feed 226 has a boundary surface 252 which is in front of the pack formation member 228 in the advancing direction and a rear boundary surface 253. The rear boundary surface 253 changes over into a support surface 254 of the extension 251. The inclination of the front boundary surface 252 and of the support surface 254 toward the inlet direction are equal and are identified by the angle $\beta$ shown in FIG. 6A at step "0" of sequence I.

Steps "0", "1", and "2" of sequence I show successive positions of the plate 24 while entering the pack formation member 228. The relationship between the feed speed $v_1$ of the plate 24 and the advancing speed $v_2$ of the pack formation member 228 is indicated by the following equation:

$$v_2 = v_1 \cdot \tan \beta.$$

The embodiment according to sequence II of FIGS. 6A–6B differs from the embodiment for performing sequence I in that, in place of the extension 251, a rotatively supported support roller 351 with a support surface 354 is provided. The support roller 351 is elastically supported at the plate feed 226 by means of a spring 356. Since in this embodiment the trailing end of one plate is uncoupled from the leading end of a subsequent plate before the subsequent plate has reached the bottom 332, an insertion surface 348 is provided similar to that shown in FIG. 5. The relationship between the feed speed $v_1$ of the plate 24 and the advancing speed $v_2$ of the pack forming support member 328 is shown by the following equation:

$$v_2 = v_1 \cdot \tan \gamma$$

wherein $\gamma$ is the angle between the surface 352 and the vertical.

In the embodiment for performing sequence III of FIGS. 6A–6B, the difference relative to the embodiment for performing sequence II is only that the two boundary surfaces 452 and 453 of the plate feed 426 are both inclined by an angle $\delta$ in relation to the advancing direction of the pack formation member 428. Otherwise, the functioning of the equipment for sequence III corresponds to that for sequence II, and in sequence III the relationship between the feed speed $v_1$ and the advancing speed $v_2$ of the pack forming member 428 is expressed by the following equation:

$$v_2 = v_1 \cdot \tan \delta.$$

It should also be noted that the distance between adjacent plates may also be adjusted in that the sheet material and thus the plates which are formed therefrom may be coated with a space-forming band so that the composite layers which consist of the actual plate and the space-forming band can be placed directly next to one another and nevertheless spaces between successive plates will be maintained. The connection between successive plates may also be produced by other types of connecting means other than those shown in FIG. 1. Particularly, when the plates are directly adjacent each other, fixing of the pack may also take place for example by means of an adhesive.

It should be further noted with regard to the illustration of FIG. 2 that for the actual formation of a pack there is approximately a control angle of 180° available which corresponds to the interval between points 12 and 13, as indicated in graph b.) shown in FIG. 2. With the method in accordance with the present invention and utilizing the arrangement of the invention, it is possible for example to produce per minute 100 plate packs each having ten plates. If it would be attempted to achieved such an output with a discontinuous advance of the pack formation member, then the pack formation member would be required to perform during the control angle of 180° ten spacing steps so that for each spacing step a time of 0.03 seconds would be available. It must be seen that it would be extremely difficult to operate the sheet punching and assembly mechanisms within a 0.03 second time interval particularly with regard to braking the loaded pack formation member, in order to bring it to a stop and to hold it stationary and then to again accelerate it. For this reason, the advance of the pack formation member with an essentially constant speed facilitates greatly the manufacturing operations.

Given the assumptions indicated above, if an operation were to be performed wherein the plates were individually punched and fed discontinuously to the pack formation member which would be moved in steps, then after each tenth cycle the completed pack would have to be assembled with some kind of connection and for assembly, ejection, and return of the pack formation member to its initial position, only half the cycle time, i.e., again only 0.03 seconds, would be available. This will emphasize the significant advantages which are achieved by utilizing the method and apparatus of the invention.

When considering the constant feed speed of the plates mentioned above, it will be recognized that when considering graph (b.) of FIG. 2, deviations from the constancy of the feed speed are definitely conceivable.

It is important that the feed speed of the plates extend essentially continuously over the time and also the advancing speed of the pack formation member wherein the speed ratio between the feed speed and the advancing speed of the pack formation member must be constant and adapted to the geometric conditions of the feed and the pack formation member.

It is easily conceivable that the plates which are located in the pack formation member 28 will be pushed out in a direction along the axis z from the pack formation member and will only be connected in this new position. They may be ejected into a comb-like guidance device similar to the pack formation member wherein further processing, for example securing, occurs. This arrangement would have the advantage that there would be more time available for example for return of the pack formation member. The time savings relate to the time section between points 14 and 16 and the return period for the pack formation member between points 18 and 19 would be increased by this time section.

While specific embodiments of the invention have been shown and described in detail to illustrate the application of the inventive principles, it will be understood that the invention may be embodied otherwise without departing from such principles.

What is claimed is :

1. A method for continuously forming individual packs of punched plates particularly for use in spark extinguishing comprising the steps of:

intermittently advancing elongate sheet material to a punching station;

punching from said sheet material at said punching station in a single punching operation a number of punched plates sufficient to form one of said individual packs;

continuously moving said punched plates as an uninterrupted series with mutually abutting terminal edges to a formation member with a feed velocity for forming said number of punched plates into a pack and sequentially depositing said punched plates into said formation member during a pack forming operation; and continuously moving said formation member with a pack forming speed during said pack forming operation through a given advancing distance in a direction which is essentially perpendicular to the direction in which said punched plates are deposited into said formation member, said feed velocity and said pack forming speed being interdependently controlled such that subsequent plates of said series are arranged side face by side face in the respective pack.

2. A method according to claim 1 wherein during said sequential depositing of said punched plates into said formation member, each plate is pushed into pack forming position by a next adjacent plate.

3. A method according to claim 2 wherein the pushing engagement between adjacent plates is interrupted during said pack forming operation by lateral movement of each plate as it is deposited into said formation member caused by movement of said formation member along said advancing distance.

4. A method according to claim 3 wherein subsequent to said interruption of said pushing engagement between adjacent plates, the depositing motion of an entering plate is effected by means of engagement of said plate at its trailing end with a stationary insertion surface which is inclined relative to said advancing direction of said formation member.

5. A method according to claim 1 wherein said plates forming said pack are deposited in said formation member spaced apart a specific distance determined by means of spacers.

6. A method according to claim 1 wherein said plates are brought into direct contact in said formation member.

7. A method according to claim 1 wherein gaps are formed between adjacent plates during said punching step, said method further including the step of pushing said plates together to close said gaps before said plates are deposited into said formation member.

8. A method according to claim 1 wherein after said formation member has been moved through said advancing direction to complete a pack forming operation, it is moved into an ejection station and there ejected by movement in an ejecting direction transverse to said advancing direction.

9. A method according to claim 8 wherein a plate pack formed in said formation member is secured together by securing means either before or after arrival at said ejection station.

10. A method according to claim 9 wherein said securing means are inserted in said advancing direction at said ejection station.

11. A method according to claim 1 wherein said punched plates are propelled to said formation member by driving engagement of said sheet material at a location preceding said punching station.

12. A method according to claim 1 wherein said formation member after ejection of a formed pack is returned during performance of said punching step into an initial position of said pack forming operation for formation of a subsequent pack.

13. Apparatus for forming packs of punched plates particularly for use in spark extinguishing comprising:

means for intermittently feeding elongate sheet material to a punching station through a length equivalent to the length of a number of plates sufficient to form a complete pack;

multiple punching means at said punching station for punching in a single operation said number of plates;

plate feeding means for moving said number of plates as an uninterrupted series of plates with mutually abutting terminal edges from said punching station to a pack forming station;

pack formation means at said pack forming station for receiving said punched plates;

advancing means for moving said pack formation means along a pack forming advancing distance from a starting position to an end position;

transport guidance means for guiding said formation means from said pack forming station for moving said formation means to an ejection station;

pack ejection means at said ejection station; and means for interdependently controlling said multiple punching means, said plate feeding means, said advancing means, said transport guidance means, and said ejection means such that said feeding means and said advancing means move continuously until said pack formation means have reached said end position of said advancing distance, said pack formation means being then further transported into said ejection station where said plate pack is ejected, said pack formation means being then moved back into said starting position of said advancing distance, said punching process for a next-formed plate pack being commenced before said formation means has completed its return to said starting position.

14. Apparatus according to claim 13 wherein said plate feeding means for moving said punched plates from said punching station to said pack forming station operate in cooperation with said intermittently feeding means with the driving force for advancing said plates being provided by said intermittently feeding means.

15. Apparatus according to claim 13 further comprising securing means located at said ejection station to secure together plates forming a single pack.

16. Apparatus according to claim 15 comprising means for feeding said securing means at said ejection station.

17. Apparatus according to claim 16 wherein said means for feeding said securing means moves at said ejection station in the same direction as the advancing direction of said pack formation means.

18. Apparatus according to claim 13 wherein said intermittently feeding means, said multiple punching means, said transport guidance means, and said pack ejection means are arranged to be driven by common drive means.

19. Apparatus according to claim 13 wherein said plate feeding means is arranged to end at a predetermined distance from an inlet side of said pack formation means.

20. Apparatus according to claim 13 wherein said pack formation means is formed by a pack formation member having a comb-like construction with plate receiving chambers being defined between successive comb-tooth-like spacers.

21. Apparatus according to claim 20 wherein said spacers have formed at the rear side thereof taken in the advancing direction of said pack formation means an oblique surface which is inclined toward the advancing direction of said pack formation means, said oblique surface extending to form an adjacent rear pack formation surface which is essentially perpendicular to the advancing direction of said pack formation means, said rear pack formation surface being essentially parallel with respect to a front pack formation surface of a next adjacent spacer located rearwardly of said first spacer, said next adjacent spacer being spaced apart from this surface by a distance approximately equivalent to the thickness of a plate.

22. Apparatus according to claim 21 wherein said plate feeding means is spaced a predetermined distance from the inlet side of said pack formation means and wherein said predetermined distance is equal or larger than the height of said rear pack formation surface measured in the inlet direction of said plate.

23. Apparatus according to claim 20 wherein said plate feeding means operates to impart a limited swiveling motion to said plates as they enter said plate formation means, said swiveling motion acting about a swivel axis which is perpendicular to the inlet direction of said plates and to the advancing direction of said pack formation means.

24. Apparatus according to claim 23 wherein said plate feeding means is formed with a front boundary surface located adjacent said pack formation means at a point at which said punched plates move from said plate feeding means into said pack formation means, said front boundary surface being formed with a plate insertion surface which is inclined in the advancing direction of said pack formation means.

25. Apparatus according to claim 13 wherein said pack formation means is configured to form said packs with successive adjacent punched plates in direct mutual contact with each other.

26. Apparatus according to claim 25 wherein said plate feeding means is formed to include a boundary surface past which said punched plates are fed. said boundary surface being located forwardly taken in the advancing direction of said pack formation means and being inclined in a direction toward the advancing direction of said pack formation means.

27. Apparatus according to claim 26 wherein said pack formation means include an essentially stationary support surface which is configured to extend into said pack formation means, said stationary support surface being first engaged with the leading edge of a plate entering said pack formation means and subsequently with the rear surface of said plate after entry thereof into said pack formation means.

28. Apparatus according to claim 27 wherein said stationary support surface is inclined toward the advancing direction of said pack formation means and extends from an inlet side of said pack formation means to the bottom thereof in the advancing direction of said pack formation means.

29. Apparatus according to claim 25 wherein said plate feeding means comprise a rotatable roller located adjacent the point at which said punched plates enter said plate formation means, said rotatable roller providing a supporting surface for guiding said plates into position in the formation of said pack.

30. Apparatus according to claim 29 wherein said rotatable roller is resiliently supported so as to be deflectable in the advancing direction of said pack formation means.

31. A method for continuously forming individual packs of punched plates particularly for use in spark extinguishing comprising the steps of:

intermittently advancing elongate sheet material to a punching station;

punching from said sheet material at said punching station in a number of punched plates sufficient to form one of said individual packs;

continuously moving said punched plates as an uninterrupted series with mutually abutting terminal edges to a formation member with a feed velocity for forming said number of punched plates into a pack and sequentially depositing said punched plates into said formation member during a pack forming operation; and continuously moving said formation member with a pack forming speed during said pack forming operation through a given advancing distance in a direction which is essentially perpendicular to the direction in which said punched plates are deposited into said formation member, said feed velocity and said pack forming speed being interdependently controlled such that subsequent plates of said series are arranged side face by side face in the respective pack.

32. A method according to claim 31, wherein said punched plates are individually punched from said elongate sheet material and are laterally offset with respect to said elongate sheet material into said uninterrupted series.

33. Apparatus for forming packs of punched plates particularly for use in spark extinguishing comprising:

means for intermittently feeding elongate sheet material to a punching station through a length equivalent to the length of a number of plates sufficient to form a complete pack;

punching means at a punching station for punching said number of plates;

plate feeding means for moving said number of plates as an uninterrupted series of plates with mutually abutting terminal edges from said punching station to a pack forming station;

pack formation means at said pack forming station receiving said punched plates;

advancing means for moving said pack formation means along a pack forming advancing distance from a starting position to an end position;

transport guidance means for guiding said formation means from said pack forming station for moving said formation means to an ejection station;

pack ejection means at said ejection station; and means for interdependently controlling said multiple punching means, said plate feeding means, said advancing means, said transport guidance means, and said ejection means such that said feeding means and said advancing means move continuously until said pack formation means have reached said end position of said advancing distance, said pack formation means being then further transported into said ejection station where said plate pack is ejected, said pack formation means being then moved back into said starting position of said advancing distance, said punching process for a next-formed plate pack being commenced before said formation means has completed its return to said starting position.

* * * * *